United States Patent [19]

Emmons

[11] 4,178,331

[45] Dec. 11, 1979

[54] TWO STAGED CARBURETOR WITH ARRANGEMENT FOR REDUCING FUEL SPILLAGE

[75] Inventor: J. Bruce Emmons, Lindenhurst, Ill.

[73] Assignee: Outboard Marine Corporation, Waukegan, Ill.

[21] Appl. No.: 865,613

[22] Filed: Dec. 29, 1977

[51] Int. Cl.[2] ..... F02M 11/02

[52] U.S. Cl. ..... 261/23 A; 261/DIG. 21

[58] Field of Search ..... 261/23 A, DIG. 21

[56] References Cited

U.S. PATENT DOCUMENTS

| | | | |
|---|---|---|---|
| 1,249,373 | 12/1977 | Funderburk | 261/DIG. 21 |
| 2,162,056 | 6/1939 | Bracke | 261/23 A |
| 2,377,852 | 6/1945 | Bliffert | 261/23 A |
| 2,564,114 | 8/1951 | Kittler | 261/23 A |
| 2,752,132 | 6/1956 | Nye | 261/41 D |
| 2,771,282 | 11/1956 | Olson et al. | 261/41 D |
| 2,867,422 | 1/1959 | Brunner | 261/41 D |
| 2,970,822 | 2/1961 | Ernest | 261/23 A |
| 3,186,691 | 6/1965 | Manning, Jr. | 261/23 A |
| 3,975,466 | 8/1976 | Bradshaw | 261/23 A |
| 4,063,540 | 12/1977 | Pace | 261/DIG. 21 |

*Primary Examiner*—Tim R. Miles

*Attorney, Agent, or Firm*—Michael, Best & Friedrich

[57] ABSTRACT

Disclosed herein is a carburetor comprising a first stage including a vertically extending primary air induction passage including a venturi section and a portion downstream of and below the venturi section, a primary fuel passage communicating with the venturi section of the primary air induction passage and with a fuel source, and a primary throttle valve mounted in the downstream portion of the primary air induction passage for movement between a partially open position and a fully open position, and a second stage including a vertically extending secondary air induction passage including a venturi section and a portion downstream of and below the venturi section, a secondary fuel passage communicating with the venturi section of the secondary air induction passage and with a fuel source, and a secondary throttle valve mounted in the downstream portion of the secondary air induction passage for movement between an open position and a closed position, and a fuel or air passage communicating between the primary and secondary air induction passages for draining fuel accumulating in the secondary air induction passage above the secondary throttle valve to the primary air induction passage.

17 Claims, 1 Drawing Figure

TWO STAGED CARBURETOR WITH ARRANGEMENT FOR REDUCING FUEL SPILLAGE

BACKGROUND OF THE INVENTION

Figure 1:
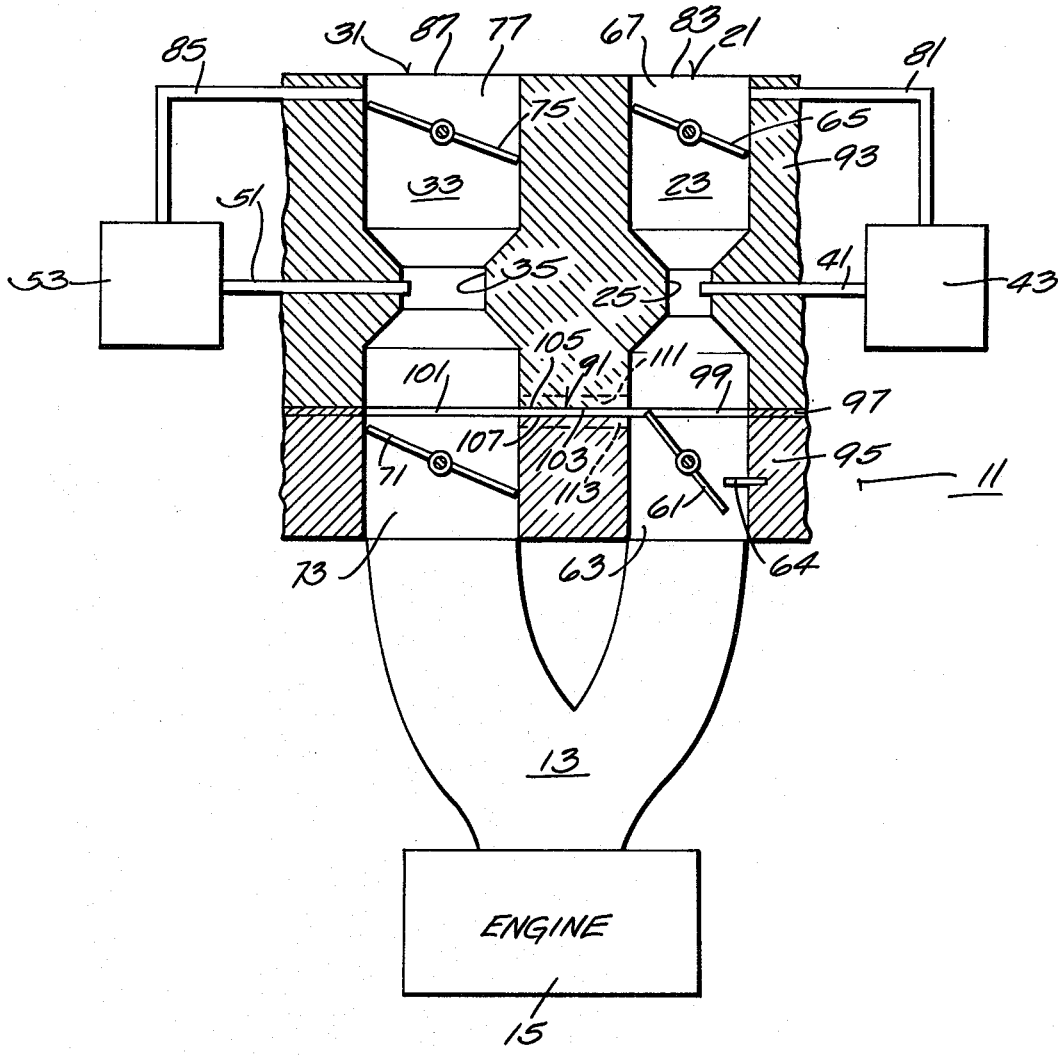

The invention relates to carburetors.

More particularly, the invention relates to two-stage carburetors which, in the past, have been mounted on marine internal combustion engines in upright relation.

Such carburetors have, during the engine starting process, occasionally spilled fuel into the boat in which the engine was mounted as a result of operation of a pump supplying fuel to a float bowl which, in turn, communicated through a vent line with the primary and/or secondary air induction passage. During such engine starting, the throttle valve in the secondary air induction passage was closed and the fuel supplied into the secondary air induction passage through the vent line occasionally spilled out of the top of the secondary air induction passage or leaked through the bearings for the throttle valve or the choke valve.

SUMMARY OF THE INVENTION

The invention provides a carburetor comprising a first stage including, a vertically extending primary air induction passage including a venturi section and a portion downstream of and below the venturi section, a primary fuel passage communicating with the venturi section of the primary air induction passage and with a fuel source, and a primary throttle valve mounted in the downstream portion of the primary air induction passage for movement between a partially open position and a fully open position, and a second stage including a vertically extending secondary air induction passage including a venturi section and a portion downstream of and below the venturi section, a secondary fuel passage communicating with the venturi section of the secondary air induction passage and with a fuel source, and a secondary throttle valve mounted in the downstream portion of the secondary air induction passage for movement between an open position and a closed position, and fuel or air passage means communicating between the primary and secondary air induction passages for draining fuel accumulating in the secondary air induction passage above the secondary throttle valve to the primary air induction passage.

In accordance with an embodiment of the invention, the carburetor includes a first casting including the venturi sections of the primary and secondary air induction passages, a second casting including the downstream portions of the primary and secondary air induction passages, and a gasket sandwiched between the first and second castings and including first and second apertures respectively forming portions of the primary and secondary air induction passages and the fuel passage means comprises a passageway in one of the first casting, the second casting, and the gasket.

In accordance with an embodiment of the invention, the passageway comprises a slot in the gasket extending between the first and second apertures.

In accordance with an embodiment of the invention, the first casting includes a face engaging the gasket and the passageway comprises a slot in the face extending between the primary and secondary air induction passages.

In accordance with an embodiment of the invention the second casting includes a face engaging the gasket and the passageway comprises a slot in the face extending between the primary and secondary air induction passages.

In accordance with an embodiment of the invention, the secondary air induction passages includes a portion upstream of the venturi section, the carburetor further includes a float chamber providing the fuel source for at least one of the primary and secondary fuel passages, and the carburetor further includes a vent line communicating between the float chamber and the upstream portion of the primary and/or secondary air induction passage.

One of the principal features of the invention is the provision, in a two-stage carburetor, of a fuel passageway which serves the dual function of draining fuel from a secondary air induction passage into a primary air induction passage so as to minimize the risk of fuel spillage into a boat hull and which, in addition, serves to provide improved engine acceleration performance by reducing any time delay occurring consequent to opening of the throttle valve of the secondary stage of the carburetor.

Other features and advantages of the embodiments of the invention will become known by reference to the following general description, appended claims and the drawing.

THE DRAWING

FIG. 1 is a schematic view of a two-stage carburetor embodying various of the features of the invention.

Before explaining the embodiments of the invention in detail, it is to be understood that the invention is not limited in its application to the details of construction and the arrangements of the components set forth in the following description or illustrated in the drawing. The invention is capable of other embodiments and of being practiced and carried out in various ways. Also it is to be understood that the phraseology and terminology employed herein is for purpose of description and should not be regarded as limiting.

GENERAL DESCRIPTION

Shown schematically in the drawings is a two-stage carburetor 11 which communicates through an intake manifold 13 with one or more cylinders or combustion chambers (not shown) of an internal combustion engine 15 and which is located in generally upright relation, i.e. the air flows downwardly through the carburetor 11 into the intake manifold 13.

The carburetor 11 includes a first or primary stage 21 including a first or primary air induction passage 23 including a venturi section 25. In addition, the carburetor 11 includes a second or secondary stage 31 including a second or secondary air induction passage 33 including a venturi section 35. Communicating with the venturi section 25 of the primary stage 21 is a fuel delivery tube or passage 41 which extends from a fuel source which can be in the form of the float bowl or reservoir 43, or otherwise, and which ordinarily includes a metering orifice (not shown) which limits the flow of fuel to the venturi section 25.

The venturi section 35 of the second stage 31 communicates with a fuel delivery tube or passage 51 which, in turn, communicates with a source of fuel which can be the float bowl or reservoir 43 referred to above, or a separate float bowl or reservoir 53, or otherwise, and which ordinarily includes a metering orifice (not shown) which limits the flow of fuel to the venturi section 35.

The primary stage 21 also includes a throttle valve 61 located in a portion 63 of the primary air induction passage 23 downstream of the venturi section 25 and movable between a fully open position and a semi-closed or partially open position determined by suitable means such as an abutment 64 which projects into the primary air induction passage 23 and into the path of the throttle valve 61 to prevent full closure thereof. The throttle valve 61 is located in the partially open position whenever the throttle of the associated engine 15 is set for low or idle speed or when the engine 15 is not operating. The throttle valve 61 is moved from the partially open to the fully open position in response to advancement of the engine throttle above low or idle speed.

The primary stage 21 also includes a choke valve 65 located in an air intake portion 67 of the primary air induction passage 23 upstream of the venturi section 25 and movable between open and closed positions.

The secondary stage 31 includes a throttle valve 71 which is located in a portion 73 of the secondary air induction passage 33 downstream of the venturi section 35 and which is movable between a position which is closed when the engine 15 is not running or when the engine 15 is running at low or idle speed or when the engine 15 is operating below a mid-range speed, and a fully open position when the engine 15 is operating at a high speed.

Still further in addition, the second stage 31 can include a choke valve 75 located in an air intake portion 77 of the secondary air induction passage 33 upstream of the venturi section 35 and movable between open and closed positions.

One or more vent lines are normally associated with the float chambers 43 and 53 and thus, in the illustrated construction, a vent line 81 communicates with an upper part of the float bowl or reservoir 43 of the primary stage 21 and terminates adjacent to the inlet end 83 of the first stage air induction passage 23, preferably above the choke valve 65. In addition, a vent line 85 communicates with an upper part of the second stage float bowl or fuel reservoir 53 and terminates adjacent to the inlet end 87 of the second stage air induction passage 33, preferably above the choke valve 75.

As thus far disclosed the construction is conventional.

In order to prevent substantial accumulation of fuel in the air induction passage 33 of the second stage 31 when the second stage throttle valve 71 is closed during engine starting or when operating below a mid-range speed, there is provided fuel passage means in the form of a passage 91 which extends from the second stage air induction passage 33 at a point just above the throttle valve 71 to a point in the air induction passage 23 of the first stage 21 at a point located such that any substantial accumulation of fuel above the throttle valve 71 in the second stage air induction passage 33 will drain by gravity through the passage 91 into the air induction passage 23 of the first stage 21 and then into the engine manifold 13. It is noted that the throttle valve 61 in the primary stage air induction passage 23 does not hinder fuel flow therepast and that the primary stage throttle valve 61 is incapable of full closure.

Various arrangements can be employed for providing the passage 91. In the illustrated construction, the carburetor 11 includes a first or venturi section casting 93 which includes the venturi sections 25 and 35 of both stages 21 and 31 and a second or throttle body casting 95 which includes the downstream portion 63 and 73 of the air induction passages 23 and 33 of both stages 21 and 31 as well as the throttle valve 61 and 71 of both stages. The first and second castings 93 and 95 are secured together with a gasket 97 therebetween, which gasket 97 includes apertures 99 and 101 forming part of the primary and secondary air induction passages 23 and 33. In addition, the gasket 97 includes a slot 103 which communicates between the apertures 99 and 101 and which provides the passage 91. Alternatively, the passage 91 could be provided, in either of the first or second castings 93 and 95, in the respective faces 105 and 107 thereof facing the gasket 97, by employing respective slots 111 or 113 (shown in dotted outline) extending between the primary and secondary air induction passages 23 and 33. If desired, suitably drilled bores or holes (not shown) could be provided in either of the first or second castings 93 and 95 or through both castings 93 and 95 to provide the desired passage 91.

It is noted that the passage 91 also serves to supply a small flow of air to the primary air induction passage 23 from the secondary air induction passage 33 and thereby cause a small feed of fuel into the venturi section 35 of the secondary induction passage 33 even when the throttle valve 71 of the second stage 31 is closed. Such fuel flow serves to reduce any time delay which might otherwise occur before fuel feeding upon opening of the secondary stage throttle. Thus, improvement in acceleration performance is also achieved.

Various of the features of the invention are set forth in the following claims.

What is claimed is:

1. A carburetor comprising a first stage including a vertically extending primary air induction passage including a venturi section and a portion downstream of and below said venturi section, a primary fuel passage communicating with said venturi section of said primary air induction passage and with a fuel source, a primary throttle valve mounted in said downstream portion of said primary air induction passage for movement between a relatively closed position and a relatively open position, and means permitting air or fuel flow past said primary throttle valve when in said relatively closed position, and a second stage including a vertically extending secondary air induction passage including a venturi section and a portion downstream of and below said venturi section, a secondary fuel passage communicating with said venturi section of said secondary air induction passage and with a fuel source, and a secondary throttle valve mounted in said downstream portion of said secondary air induction passage for movement between an open position and a closed position, and fuel or air passage means communicating soley between said primary and secondary air induction passages closely adjacent and above said secondary throttle valve for draining fuel accumulating in said secondary air induction passage above said secondary throttle valve to said primary air induction passage.

2. A carburetor in accordance with claim 1 wherein said carburetor includes a first casting including said venturi sections of said primary and secondary air induction passages, a second casting including said downstream portions of said primary and secondary air induction passages, and a gasket sandwiched between said first and second castings and including first and second apertures respectively forming portions of said primary and secondary air induction passages and wherein said passage means comprises a passageway in one of said first casting, said second casting, and said gasket.

3. A carburetor comprising a first stage including a vertically extending primary air induction passage including a venturi section and a portion downstream of and below said venturi section, a primary fuel passage communicating with said venturi section of said primary air induction passage and with a fuel source, and a primary throttle valve mounted in said downstream portion of said primary air induction passage for movement between a partially open position and a fully open position, and a second stage including a vertically extending secondary air induction passage including a venturi section and a portion downstream of and below said venturi section, a secondary fuel passage communicating with said venturi section of said secondary air induction passage and with a fuel source, and a secondary throttle valve mounted in said downstream portion of said secondary air induction passage for movement between an open position and a closed position, a first casting including said venturi sections of said primary and secondary air induction passages, a second casting including said downstream portions of said primary and secondary air induction passages, and a gasket sandwiched between said first and second castings and including first and second apertures respectively forming portions of said primary and secondary air induction passages, and fuel or air passage means communicating between said primary and secondary air induction passages for draining fuel accumulating in said secondary air induction passage above said secondary throttle valve to said primary air induction passage, said passage means comprising a slot in said gasket extending between said first and second apertures.

4. A carburetor comprising a first stage including a vertically extending primary air induction passage including a venturi section and a portion downstream of and below said venturi section, a primary fuel passage communicating with said venturi section of said primary air induction passage and with a fuel source, and a primary throttle valve mounted in said downstream portion of said primary air induction passage for movement between a partially open position and a fully open position, and a second stage including a vertically extending secondary air induction passage including a venturi section and a portion downstream of and below said venturi section, a secondary fuel passage communicating with said venturi section of said secondary air induction passage and with a fuel source, and a secondary throttle valve mounted in said downstream portion of said secondary air induction passage for movement between an open position and a closed position, a first casting including said venturi sections of said primary and secondary air induction passages and a face with which said venturi sections communicate, a second casting including said downstream portions of said primary and secondary air induction passages, and a gasket sandwiched between said face of said first casting and said second casting and including first and second apertures respectively forming portions of said primary and secondary air induction passages, and fuel or air passage means communicating between said primary and secondary air induction passages for draining fuel accumulating in said secondary air induction passage above said secondary throttle valve to said primary air induction passage, said passage means comprising a slot in said face extending between said primary and secondary air induction passages.

5. A carburetor comprising a first stage including a vertically extending primary air induction passage including a venturi section and a portion downstream of and below said venturi section, a primary fuel passage communicating with said venturi section of said primary air induction passage and with a fuel source, and a primary throttle valve mounted in said downstream portion of said primary air induction passage for movement between a partially open position and a fully open position, and a second stage including a vertically extending secondary air induction passage including a venturi section and a portion downstream of and below said venturi section, a secondary fuel passage communicating with said venturi section of said secondary air induction passage and with a fuel source, and a secondary throttle valve mounted in said downstream portion of said secondary air induction passage for movement between an open position and a closed position, a first casting including said venturi sections of said primary and a secondary air induction passages, a second casting including said downstream portions of said primary and secondary air induction passages, and a face with which said downstream portions of said passages communicate, and a gasket sandwiched between said first casting and said face of said casting second and including first and second apertures respectively forming portions of said primary and secondary air induction passages, and fuel or air passage means communicating between said primary and secondary air induction passages for draining fuel accumulating in said secondary air induction passage above said secondary throttle valve to said primary air induction passage, said passage means comprising a slot in said face extending between said primary and secondary air induction passages.

6. A carburetor in accordance with claim 2 wherein said secondary air induction passage includes a portion upstream of said venturi section and wherein said carburetor further includes a float chamber providing the fuel source for at least one of said primary and secondary fuel passages and wherein said carburetor further includes a vent line communicating between said float chamber and said upstream portion of said secondary air induction passage.

7. A carburetor comprising a first stage including a vertically extending primary air induction passage including a venturi section and a portion downstream of and below said venturi section, a primary fuel passage communicating with said venturi section of said primary air induction passage and with a fuel source, a primary throttle valve mounted in said downstream portion of said primary air induction passage for movement between a partially open position and a fully open position, and means operatively coupled to said primary throttle valve for limiting movement thereof from said fully open position beyond said partially open position so as to prevent full closure of said primary throttle valve, and a second stage including a vertically extending secondary air induction passage including a venturi section and a portion downstream of and below said venturi section, a secondary fuel passage communicating with said venturi section of said secondary air induction passage and with a fuel source, and a secondary throttle valve mounted in said downstream portion of said secondary air induction passage for movement between an open position and a closed position, and fuel or air passage means communicating solely between said primary and secondary air induction passages and located closely adjacent and above said secondary throttle valve for draining fuel accumulating in said secondary air induction passage above said secondary throttle valve to said primary air induction passage.

8. A carburetor in accordance with claim 7 wherein said carburetor includes a first casting including said venturi sections of said primary and secondary air induction passages, a second casting including said downstream portions of said primary and secondary air induction passages, and a gasket sandwiched between said first and second castings and including first and second apertures respectively forming portions of said primary and secondary air induction passages and wherein said fuel passage means comprises a passageway in one of said first casting, said second casting, and said gasket.

9. A carburetor in accordance with claim 8 wherein said passageway comprises a slot in said gasket extending between said first and second aperatures.

10. A carburetor in accordance with claim 8 wherein said first casting includes a face engaging said gasket and wherein said passageway comprises a slot in said face extending between said primary and secondary air induction passages.

11. A carburetor in accordance with claim 8 wherein said second casting includes a face engaging said gasket and wherein said passageway includes a slot in said face extending between said primary and secondary air induction passages.

12. A carburetor in accordance with claim 8 wherein said secondary air induction passage includes a portion upstream of said venturi section and wherein said carburetor further includes a float chamber providing the fuel source for at least one of said primary and secondary fuel passages and wherein said carburetor further includes a vent line communicating between said float chamber and said upstream portion of said secondary air induction passage.

13. A carburetor comprising a first stage including a vertically extending first air induction passage including a venturi section and a portion downstream of and below said venturi section, a first fuel passage communicating with said venturi section of said first air induction passage and with a fuel source, a first throttle valve mounted in said downstream portion of said first air induction passage for movement between a relatively closed position and a relatively open position, and means permitting fuel or air flow past said first throttle valve when in said relatively closed position, and a second stage including a vertically extending second air induction passage including a venturi section and a portion downstream of and below said venturi section, a second fuel passage communicating with said venturi section of said second air induction passage and with a fuel source, and a second throttle valve mounted in said downstream portion of said second air induction passage for movement between an open position and a closed position, and fuel or air passage means communicating solely between said first and second air induction passages and located closely adjacent and above said second throttle valve for draining fuel accumulating in said second air induction passage above said second throttle valve to said first air induction passage.

14. A carburetor in accordance with claim 13 wherein said carburetor includes a first casting including said venturi sections of said first and second air induction passages, a second casting including said downstream portions of said first and second air induction passages, and a gasket sandwiched between said first and second castings and including first and second apertures respectively forming portions of said first and second air induction passages and wherein said passage means comprises a passageway in one of said first casting, said second casting, and said gasket.

15. A carburetor in accordance with claim 14 wherein said passageway comprises a slot in said gasket extending between said first and second apertures.

16. A carburetor in accordance with claim 14 wherein said first casting includes a face engaging said gasket and wherein said passageway comprises a slot in said face extending between said first and second air induction passages.

17. A carburetor in accordance with claim 14 wherein said second casting includes a face engaging said gasket and wherein said passageway includes a slot in said face extending between said first and second air induction passages.

* * * * *